US007937950B2

(12) United States Patent
Benz et al.

(10) Patent No.: US 7,937,950 B2
(45) Date of Patent: May 10, 2011

(54) DEVICE FOR FASTENING A SEQUENTIALLY OPERATED BURNER IN A GAS TURBINE ARRANGEMENT

(75) Inventors: Urs Benz, Gipf-Oberfrick (CH); Thorsten Christoph Motzkus, Wettingen (CH)

(73) Assignee: ALSTOM Technology Ltd., Baden (CH)

( * ) Notice: Subject to any disclaimer, the term of this patent is extended or adjusted under 35 U.S.C. 154(b) by 1077 days.

(21) Appl. No.: 11/692,277

(22) Filed: Mar. 28, 2007

(65) Prior Publication Data

US 2007/0227157 A1 Oct. 4, 2007

(30) Foreign Application Priority Data

Mar. 31, 2006 (DE) ..... 10 2006 015 093

(51) Int. Cl.
*F02C 7/20* (2006.01)

(52) U.S. Cl. ..... 60/796; 60/800; 431/154; 431/159; 431/343

(58) Field of Classification Search ..... 60/796, 60/225, 733, 39.17, 798, 800; 431/154, 159, 431/343

See application file for complete search history.

(56) References Cited

U.S. PATENT DOCUMENTS

| | | | | |
|---|---|---|---|---|
| 3,147,594 | A | 9/1964 | Hill et al. | |
| 3,565,968 | A | 2/1971 | Hicks, Jr. | |
| 5,069,034 | A | 12/1991 | Jourdain et al. | |
| 6,339,923 | B1 * | 1/2002 | Halila et al. | 60/798 |

FOREIGN PATENT DOCUMENTS

| | | | |
|---|---|---|---|
| DE | 4223733 | | 1/1994 |
| DE | 19948956 | | 4/2001 |
| EP | 0399336 | | 11/1990 |
| EP | 0550126 | | 7/1993 |
| EP | 0616111 | | 9/1994 |
| EP | 0620362 | | 10/1994 |
| GB | 2432198 | A * | 5/2007 |

OTHER PUBLICATIONS

Search Report for EP Patent App. No. 07103514.1 (Jan. 22, 2008).
Search Report for German Patent App. No. 10 2006 019 722.4 (Apr. 16, 2007).

(Continued)

*Primary Examiner* — Michael Cuff
*Assistant Examiner* — Craig Kim
(74) *Attorney, Agent, or Firm* — Cermak Nakajima LLP; Adam J. Cermak

(57) ABSTRACT

A device for fastening a second burner (SEV burner) (1) in a sequentially operated gas turbine arrangement, in which a fuel/air mixture is burnt in a first burner, so as to form hot gases which can subsequently be supplied, partly expanded, for a second combustion to the SEV burner (1), in which the burner is designed essentially as a flow duct, with a flow duct wall, which has an orifice (2), through which a fuel supply (3) can be introduced into the interior of the SEV burner (1), and on which are provided in the axial direction of the orifice (2), in each case opposite one another, two fastening structures (5), into which in each case a carrying structure for the further fastening of the SEV burner (1) to an external carrier (8) can be introduced. The carrying structure includes a unitary carrier plate (10) on which countercontours for fastening to the two fastening structures (5) lying opposite the orifice (2) are provided and which provides a recess which corresponds at least to the size of the orifice (2) in the flow duct wall, so that, in the state fastened to the external carrier (8), the carrier plate (10) does not cover the orifice (2) of the flow duct wall.

11 Claims, 8 Drawing Sheets

OTHER PUBLICATIONS

European Search Report for European Patent App. No. 09155057.4 (Jun. 16, 2009).

Search Report for European Patent App. No. 07103514.1 (Aug. 22, 2007).

* cited by examiner

DEVICE FOR FASTENING A SEQUENTIALLY OPERATED BURNER IN A GAS TURBINE ARRANGEMENT

This application claims priority under 35 U.S.C. §119 to German application number 10 2006 015 093.7, filed 31 Mar. 2006, the entirety of which is incorporated by reference herein.

BACKGROUND

1. Field of Endeavor

The disclosure relates to a device for fastening a second burner, SEV burner in short, in a sequentially operated gas turbine arrangement, in which a fuel/air mixture is burnt in a first burner so as to form hot gases which can subsequently be supplied, partly expanded, for a second combustion to the SEV burner which is designed essentially as a flow duct, with a flow duct wall, which has an orifice, through which a fuel supply can be introduced into the interior of the SEV burner, and on which are provided in the axial direction of the orifice, in each case opposite one another, two fastening structures, into which in each case a carrying structure for the further fastening of the SEV burner to an external carrier can be introduced.

2. Brief Description of the Related Art

A gas turbine arrangement with sequential combustion may be gathered, for example, from EP 0 620 362 B1, in which an air compressor unit is followed along a unitary rotor shaft, in the throughflow direction of the gas turbine arrangement, by an annular combustion chamber which is arranged circularly about the rotor shaft and which is fed by a multiplicity of premix burners arranged in an annularly distributed manner with an ignitable fuel/air mixture which is ignited, thus giving rise to hot gases which drive a first turbine stage provided downstream of the annular combustion chamber and connected to the rotor shaft. The hot gases emerging, partly expanded, from the first turbine stage subsequently pass into an annular flow duct, in which the partly expanded hot gases are mixed anew with fuel and, with an autoignitable hot-gas/fuel mixture being formed, are ignited within a second annular combustion chamber surrounding the rotor shaft circularly or annularly. The hot gases thereby arising pass, downstream, into a second low-pressure turbine stage, as it is known, in order to perform further expansion work.

It is appropriate, further, to consider in more detail the second or sequential burner which is designed as a flow duct and is designated, further, as an SEV burner, particularly with regard to the fastening of the flow duct within the gas turbine plant and the thermal and mechanical properties of the flow duct.

An SEV burner 1 known per se, designed as a flow duct, may be gathered from the illustration according to FIG. 2 which, in the exemplary embodiment shown, has a rectangular flow duct cross section and is delimited by four flow duct walls, an upper 1*o*, a lower 1*u*, and two lateral flow duct walls 1*s*. On the upper flow duct wall 1*o* an orifice 2 is introduced, through which a fuel lance 3 serves for the fuel enrichment of the partly expanded hot gases entering the SEV burner. To mount the fuel lance 3, the latter is inserted from above through the orifice 2 of the flow duct 1, the lance tip 3 terminating and being positioned with a defined play with respect to the upper flow duct wall 1*o*. The play to be provided between the lance tip and the upper flow duct wall should allow as simple a mounting of the lance tip as possible, but cause as low leakages as possible between the components. The SEV burner 1 has, upstream of its flow duct, a fastening flange 4 which is connected to a first expansion stage, not illustrated any further, of the gas turbine plant, that is to say connected to a first turbine stage. The SEV burner is firmly connected axially, at least on one side, to the gas turbine via the fastening flange 4. For the further fastening of the SEV burner, the latter provides in each case, on its top side 1*o*, fastening structures of collar-like design in the form of reception rails 5 which are in each case arranged in pairs opposite the orifice 2 along the burner axis A and into which in each case a carrying structure 6 can be axially inserted separately. The carrying structures 6 have provided on them in each case two fastening devices 7 of screw-like or pin-like design which in each case fix the carrying structures 6 to an external carrier 8, projecting beyond the SEV burner 1, of the gas turbine arrangement. As may be gathered from the illustration in FIG. 2, the fuel lance 3 likewise projects through the external carrier 8, a supporting ring 3' with integrated piston ring serving for ensuring sealing off between the radially inner region and the external carrier 8, particularly in the event of thermally induced dimensional variations which occur, above all, during the starting, but also during the operation, of the gas turbine arrangement. Thus, for example, the fuel lance tip is displaced or bent elastically through the burner in the flow direction, so that, on the one hand, a required minimum play between the external carrier and the fuel lance tip must be provided for this purpose and, on the other hand, so as to avoid leakage streams, it is appropriate to seal off this play with a piston ring which is not illustrated in FIG. 2. Moreover, that flange end 4' of the flow duct 1 which lies opposite the fastening flange 4 is connected directly to the external carrier 8 via fixing noses 9 provided on the upper duct sidewall 1*o*, so that the SEV burner 1 is detained axially. By contrast, in the circumferential direction, the SEV burner 1 is fixed in relation to the external carrier 8 by the two carrying structures 6 and the fastening device 7 connected to these.

When the gas turbine arrangement is in an operating situation, very high combustion temperatures and high hot gas flow velocities occur due to the combustion processes taking place in the SEV burner region, so that the flow duct walls of the SEV burner are exposed to extreme load thermally and also mechanically, such as, in particular, the upper flow duct wall 1*o*, in which is introduced an orifice 2 which weakens the flow duct wall structure and due to which the rigidity of the SEV burner 1 is at least locally reduced. Owing to the reduced surface rigidity in this region, relative movements in the form of vibrations occur between the upper duct sidewall 1*s* and the fuel lance 3 in the region of their mutual contact on account of the process conditions described above, with the result that surface wear sets in at the contact point both on the SEV burner in the region of the orifice 2 and on the burner lance 3 and may lead not only to local material deterioration, such as, for example, corrosion, etc., but also to increased leaks between the fuel lance 3 and SEV burner 1.

SUMMARY

One of numerous aspects of the present invention includes developing a device for fastening a second burner, SEV burner in short, in a sequentially operated gas turbine arrangement, in which a fuel/air mixture is burnt in a first burner, so as to form hot gases which can subsequently be supplied, partly expanded, for a second combustion to the SEV burner which is designed essentially as a flow duct, with a flow duct wall, which has an orifice, through which a fuel supply can be introduced into the interior of the SEV burner, and on which are provided in the axial direction of the orifice, in each case opposite one another, two fastening structures, into which in each case a carrying structure for the further fastening of the SEV burner to an external carrier can be introduced, in such a way that operationally and structurally induced vibrations occurring particularly at the location of the orifice between the SEV burner and the fuel lance, are to be avoided. Furthermore, in addition to the wish to improve the mechanical structural rigidity of the SEV burner, the thermal load on the plant components surrounding the SEV burner is to be reduced, without the structural rigidity of the SEV burner itself in this case being impaired. All the measures required for this purpose are to be implementable as simply as possible in structural terms and in an assembly-friendly way.

Features advantageously developing principles of the present invention may be gathered from the description, particularly with reference to the exemplary embodiments.

According to one exemplary embodiment, a device is formed in which the carrying structure is designed as a unitary carrier plate, on which countercontours for fastening to the two fastening structures lying opposite the orifice are provided and which provides a recess which corresponds at least to the size of the orifice in the flow duct wall, so that, in the state fastened to the external carrier, the carrier plate does not cover the orifice of the flow duct wall.

Yet another aspect of the present invention includes the substitution of the two separately formed carrying structures, which, according to the prior art, can be inserted axially into the two reception rails lying axially opposite the orifice separately, by a unitary coherent carrier plate which can likewise be pushed axially into the fastening structures or reception rails provided on the duct sidewall top side.

Owing to the one-piece formation of the carrier plate which surrounds the orifice in a frame-like manner and firmly connects to one another axially the fastening structures provided on the SEV burner, the reduced rigidity of the SEV burner in the region of the orifice through which the burner lance projects into the SEV burner is at least partially compensated. Furthermore, a particularly advantageous embodiment provides for the provision, in the region of the orifice, of additional connection devices between the orifice edge and the carrier plate, which connection devices make additional radial support between the orifice edge and the carrier plate possible. At the orifice, at least one collar, preferably two collars arranged diametrically opposite one another at the orifice edge, are provided, which project vertically beyond the flow duct wall and in each case have a fastening lip which can be introduced into a groove-shaped recess provided on the carrier plate. The possibilities for the actual implementation of an additional connection of this type between the orifice edge and the carrier plate are described in more detail below with reference to the exemplary embodiments.

Furthermore, for the purpose of heat radiation protection of the gas turbine components surrounding the SEV burner, in particular those components which lie directly opposite the lower flow duct wall, according to an exemplary embodiment at least one plate element is mounted on the lower flow duct wall via spacer devices in such a way that, on the one hand, the at least one plate element is mounted so as to be spaced apart at least in regions from the lower flow duct wall and, on the other hand, slidably with respect to the latter. This ensures, on the one hand, that, by the plate element being mounted, spaced apart, on the lower flow duct wall, the latter can be cooled by what is known as effusion cooling conventional per se, but, on the other hand, direct heat radiation load on the plant components lying opposite the lower flow duct wall is avoided by the plate element. By virtue of this measure, the problem, existing hitherto, of the oxidation of adjacent gas turbine components on account of the exceedingly high exposure to heat radiation can be greatly limited, so that the provision of hitherto customary coatings for protection against surface oxidation on the corresponding plant components is no longer required with the aid of the device according to the solution. Furthermore, the plate element, which is nonetheless mounted slidably in relation to the lower flow duct wall, contributes in some part to an increase in rigidity at least of the lower flow duct wall, especially since the latter is not connected to a carrier part, as stated above with regard to the upper flow duct wall. To explain advantageous developments of the principles of the present invention with regard to the provision of at least one plate element on the lower flow duct wall, reference may likewise be made to the further descriptions relating to the exemplary embodiments.

DETAILED DESCRIPTION OF EXEMPLARY EMBODIMENTS

Figure 1:
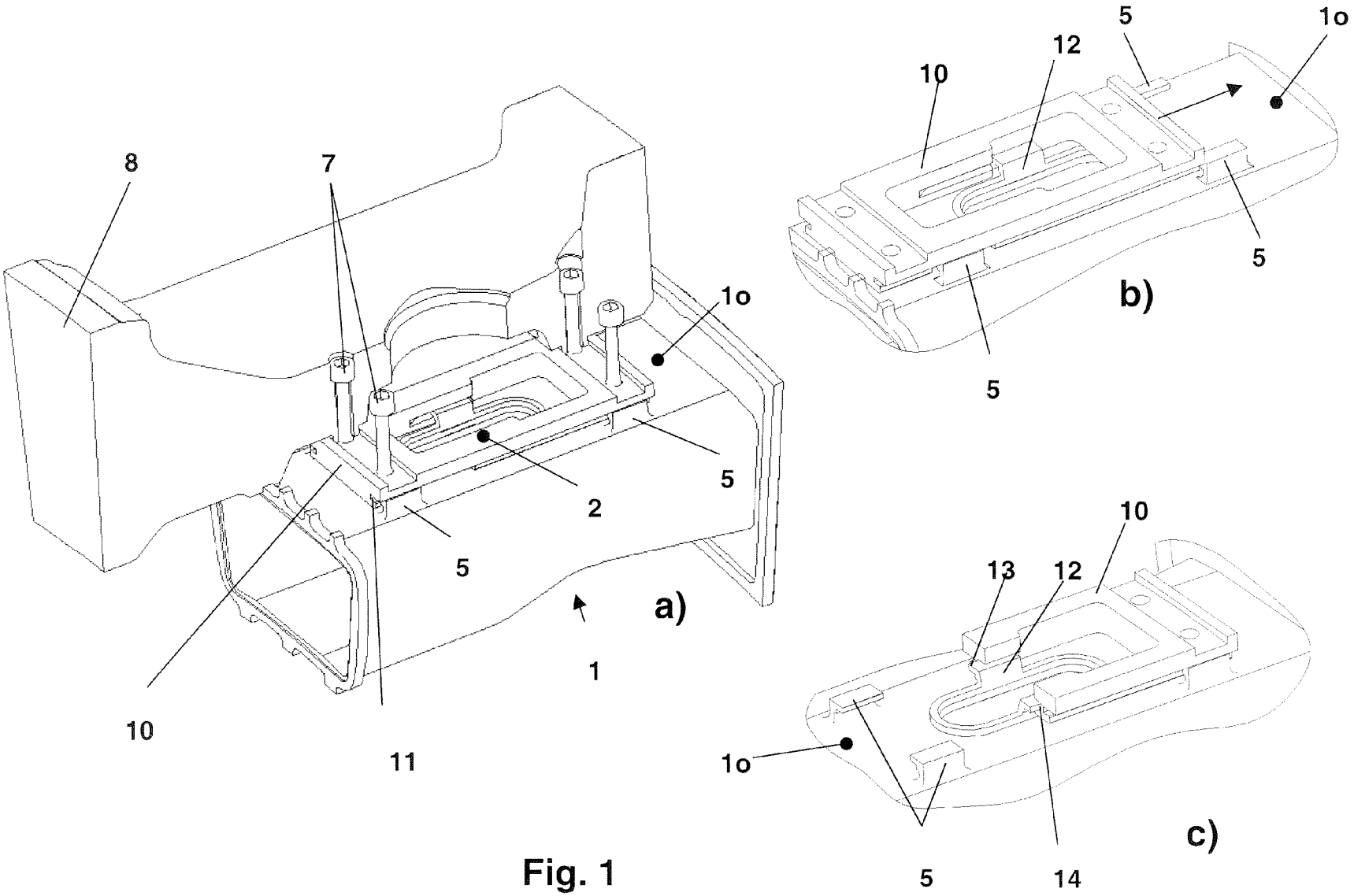
FIGS. 1*a, b, c* show perspective illustrations or part illustrations of an SEV burner fastening with carrier plate.

FIG. 1*a* illustrates a perspective illustration of an SEV burner 1, the upper flow duct wall 1*o* of which is evident, on which are provided the fastening structures known per se, designed as reception rails 5, into which a carrier plate 10, manufactured as a one-piece component and itself having corresponding lateral guide groove structures 11, can be pushed in the axial direction of the SEV burner 1. The carrier plate 10 has an orifice (FIG. 1*b*) which, in the case of the exemplary embodiment according to FIG. 1*a*, surrounds the orifice 2 within the upper flow duct wall 1*o* in a frame-like manner, without covering it, even only partially, thus still ensuring that the burner lance, not illustrated in FIG. 1*a*, can be mounted, unimpeded, into the SEV burner 1 through the orifice 2. Likewise according to the prior art explained in the introduction, the fastening device 7 of screw-like or pin-like design serve for fixing the carrier plate 10 to an external carrier 8. In the illustration of a detail according to FIG. 1*b*, the operation of mounting the carrier plate 10 for fastening to the upper flow duct wall 1*o* of the SEV burner is evident. In this case, the reception grooves 11 of the carrier plate 10 pass, due to axial displacement (see the arrow), into the corresponding fastening structures 5 which are preferably connected in one piece to the SEV burner 1 and serve as reception rails. It is also possible to carry out the mounting of the carrier plate in the opposite direction to the direction indicated in FIG. 1*b* via the arrowed illustration. Basically, it is to be stated that the structural weakening caused within the SEV burner by the orifice 2 can be at least partially compensated for solely by the provision of a one-piece carrier plate 10 which is fastened to the SEV burner in regions lying axially opposite the orifice 2.

As may be gathered from a closer consideration of the exemplary embodiment according to FIG. 1, it is particularly advantageous insofar as, at the orifice 2, in particular in the region of the orifice edge, at least one, preferably two collars 12 lying diametrically opposite the orifice edge are provided, which project vertically beyond the surface of the upper flow duct wall 1*o* and provide lateral fastening lips 13 which come into engagement with a corresponding groove-shaped recess 14 within the carrier plate 10, according to the part illustration in FIG. 1*c*. By collars 12 of this type being provided, on the one hand, a firm radial connection of the orifice edge to the carrier plate 10 is made, with the result that the circumferential rigidity of the orifice edge of the orifice 2 is increased considerably, and, on the other hand, the collars 12 serve as a centering aid for mounting the lance tip, to be introduced into the orifice 2, of the burner lance, not illustrated any further.

Since the carrier plate 10 can be mounted merely by axial displacement in relation to the fastening structures 5 designed as reception rails and to the collars 12, the axial fixing of the carrier plate 10 requires an additional fastening to the external carrier 8 via the fastening device 7, as it were according to the practice customary hitherto in the prior art.

Figure 3:
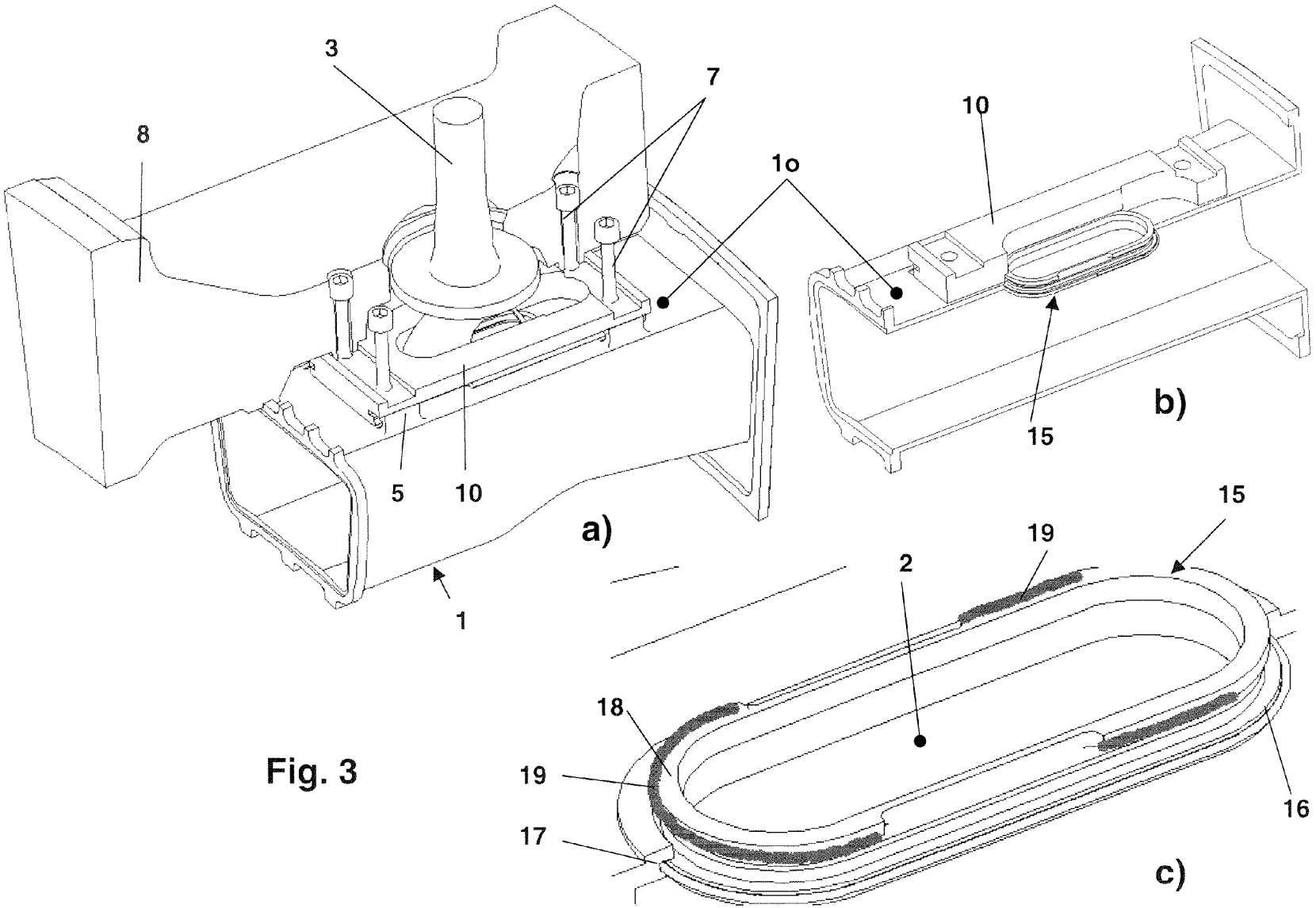

The collars 12 may, on the one hand, be produced in one piece from the same material from which the at least upper flow duct wall 1*o* is also produced, but alternatively it is likewise possible to insert the collars 12 in the form of an additional modular insert into the orifice 2 of the SEV burner from below, as the exemplary embodiment shows, further, with reference to FIG. 3.

FIG. 3*a* illustrates the mounted state of a carrier plate 10 in relation to the SEV burner 1, the burner lance 3 being illustrated in the mounted state and projecting both through the carrier plate 10 and through the orifice 2 provided in the SEV burner. In the illustrations of details according to FIGS. 3*b* and *c*, in each case an insert element 15 of modular design is provided next to the fastening of the carrier plate 10 to the fastening structures 5 of rail-like design, is inserted into the orifice of the SEV burner from the inside of the flow duct and projects vertically beyond the upper flow duct wall 1*o*. For fluidtight closure between the insert element 15 of modular design and the flow duct wall, the insert element 15 has a lower peripheral supporting web 16 which can be inserted flush, and with an exact fit, into a reception contour 17 along the circumferential edge of the orifice 2. In the region of the insert element 15 which projects vertically beyond the upper duct sidewall 1*o*, likewise collar-like portions 18 are provided, which can be introduced into corresponding reception grooves provided in the carrier plate 10. The carrier plate 10 thereby undergoes radial connection to the insert element 15 and is thus centered and fixed with respect to the SEV burner. On account of the axially symmetrical design both of the carrier plate 10 and of the insert element 15, it is possible, depending on the available mounting space, to mount the carrier plate 10 on both sides with respect to the axial direction for introduction purposes. In the region of the collar-like portions 18, it is advantageous to provide additional sealing materials 19 or sealing devices, as may be gathered from the illustration of the detail according to FIG. 3*c*.

By the insert element 15 being formed separately, a handy component is thus provided, of which the entire surface or at least the contact surfaces with the SEV burner and with the fuel lance may be provided with a wear-resistant surface layer. The hitherto complicated surface protection, which is to be carried out by plasma treatment, in particular, on what is known as the balcony of the fuel lance, can thereby be avoided. Should wear nevertheless occur at the contact surface between the fuel lance and the insert element against which the fuel lance bears, centered and flush, it is necessary merely to exchange and replace the insert element 15 which can otherwise be produced cost-effectively.

Referring to the perspective part illustration according to FIG. 4*a*, the easy mountability of the insert element 15 from below in the direction of the orifice 2 of the SEV burner is evident. During mounting, preferably, a sealing device 19 running around on the orifice 2 along the reception contour 17 may be provided, in order to afford a fluidtight sealing off of the inner flow duct with respect to the use later to be made of the burner lance. Further fixing of the insert element 15 with respect to the SEV burner is not required, especially since a mutual firm assembly between the carrier plate 10 and insert element 15 can be made by the axial displacement of the carrier plate 10 and by the collar-like portions 18 being brought into engagement with the groove-shaped recesses 14 of the carrier plate 10. This may also be gathered from the part cross-sectional illustration according to FIG. 4*b*. Thus, insert element 15 bears with its supporting web 16, flush and partially overlapping with the reception contour 17, against the orifice edge of the upper flow duct wall 1*o*. Furthermore, the reception contour 17 provides a groove-shaped recess 17' into which the sealing device 19 is introduced. Furthermore, the insert element 15 has, projecting vertically beyond the upper flow duct wall 1*o*, a collar-like portion 18 which issues into a groove-shaped recess 14 of the carrier plate 10 and is pressed by the latter vertically upward against the reception contour 17. Moreover, insert element 15 provides for its cooling what are known as effusion holes 20 which issue on the surface which faces the hot gases within the flow duct.

Figure 4:
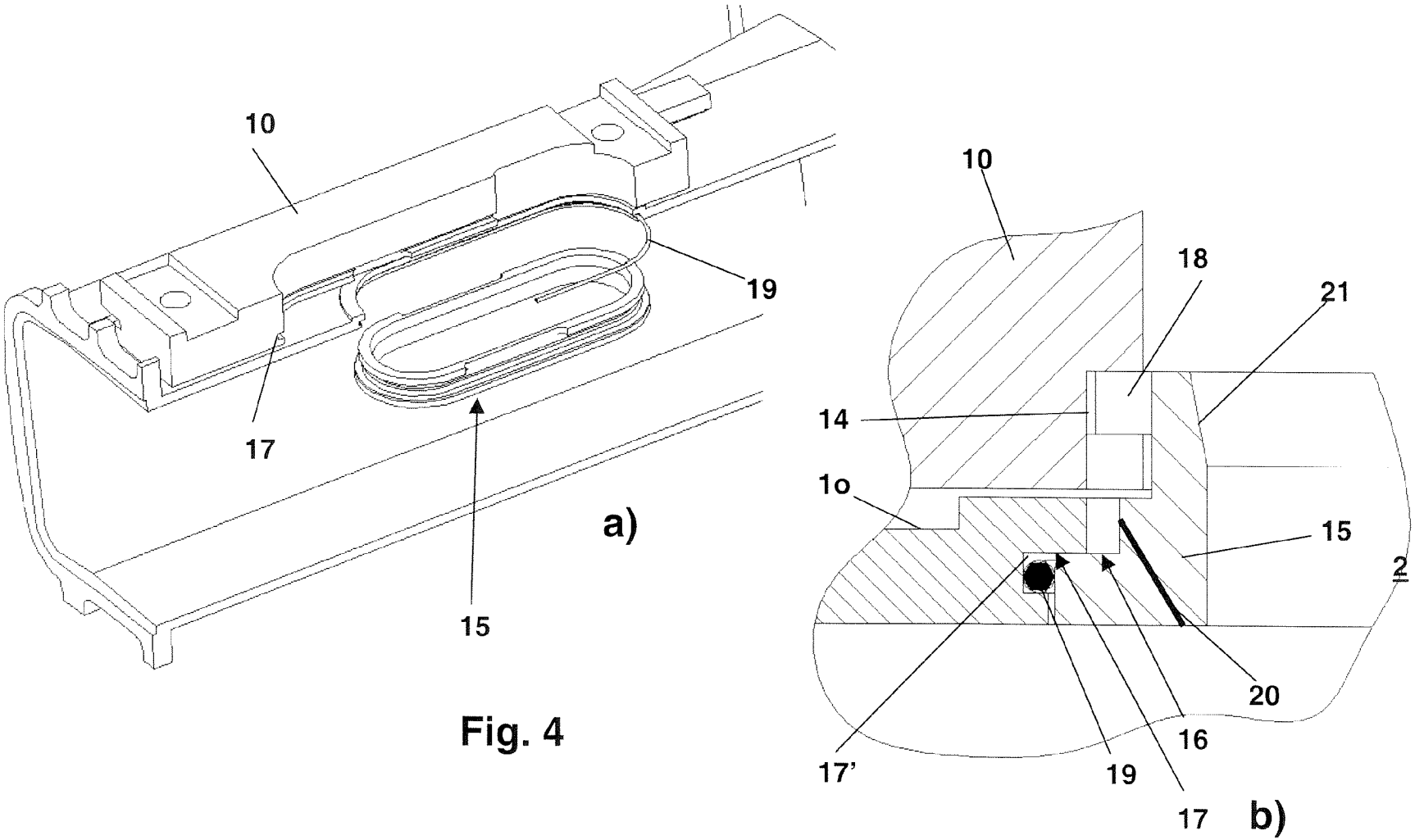

It may also be gathered from the part cross-sectional illustration according to FIG. 4*b* that the insert element 15 has an introduction flank 21 which is inclined obliquely with respect to the vertical and faces the orifice 2 and which allows a better and simplified centering and mounting of the fuel lance in the SEV burner 1.

Figure 5:
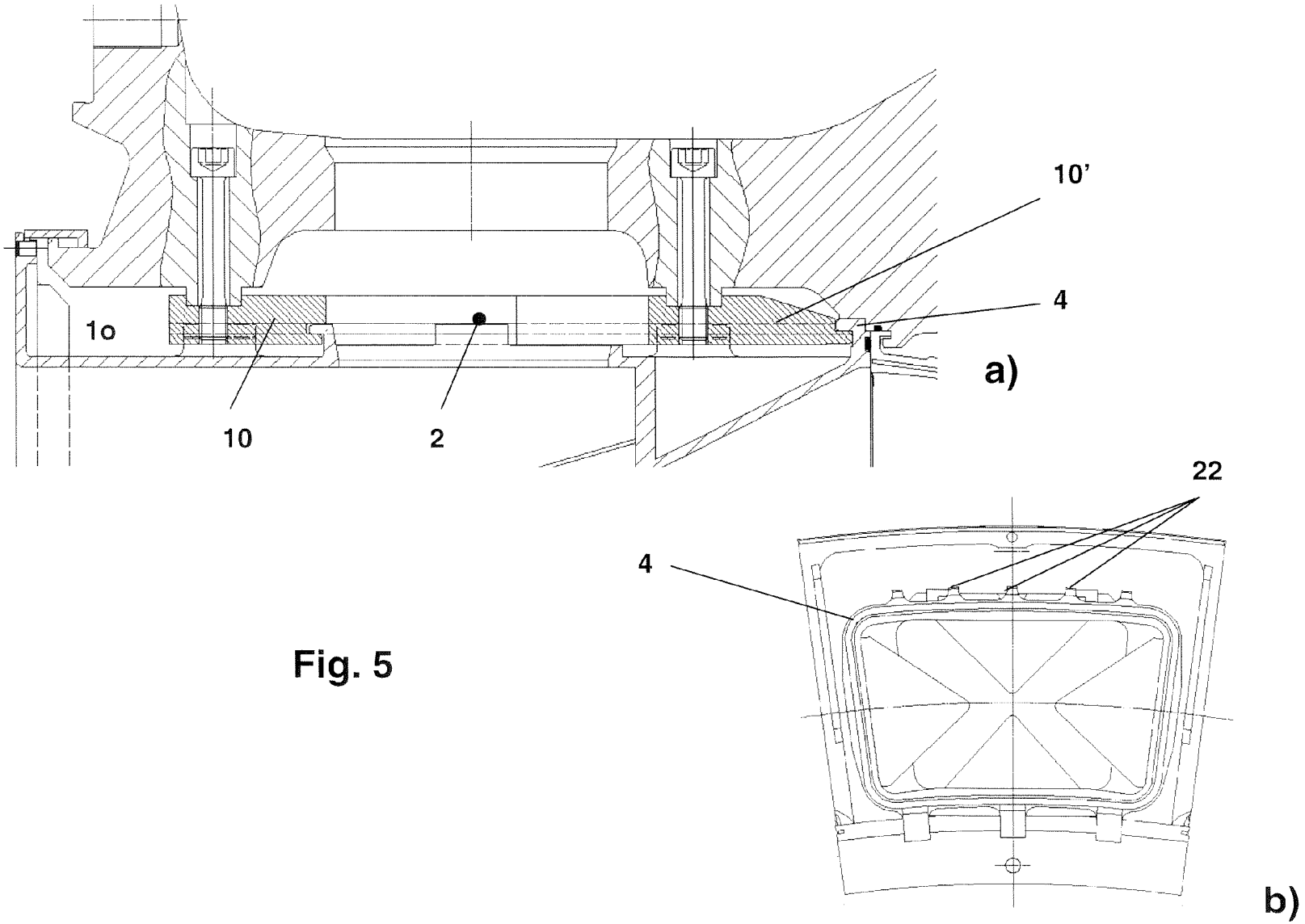

FIG. 5*a* illustrates a further alternative embodiment in terms of the carrier plate 10. FIG. 5*a* shows a part longitudinal section through the orifice region 2 of the upper flow duct wall 1*o*, the right region of the part longitudinal sectional illustration illustrating a part of the fastening flange 4 which is connected, flush, to a first turbine stage region provided upstream. The carrier plate 10 has an axial prolongation 10' which is oriented in the direction of the fastening flange 4 and with which the carrier plate 10 bears in the axial direction against the region of the fastening flange 4 and thus experiences axial detention. The mounting of the carrier plate 10 with respect to the SEV burner takes place opposite to the flow direction in which the hot gases entering the SEV burner from the turbine stage flow through the SEV burner.

FIG. 5*b* shows an illustration in an axial viewing direction opposite the flow direction of the flow duct of the SEV burner. In this case, it is evident that the burner flange 4 has provided on it additional fastening hooks 22, at which the carrier plate 10 can be fixed axially and radially, with the result that the outside diameter of the burner inlet is defined radially with respect to the gas turbine outlet, not illustrated any further. This prevents a lowering of the SEV burner inlet with respect to the first turbine stage provided upstream as a result of creep. Furthermore, the SEV burner is fixed to the carrier plate 10 against axial displacement with respect to the external carrier 8 (not illustrated) via corresponding fastening device 7.

Figure 2:
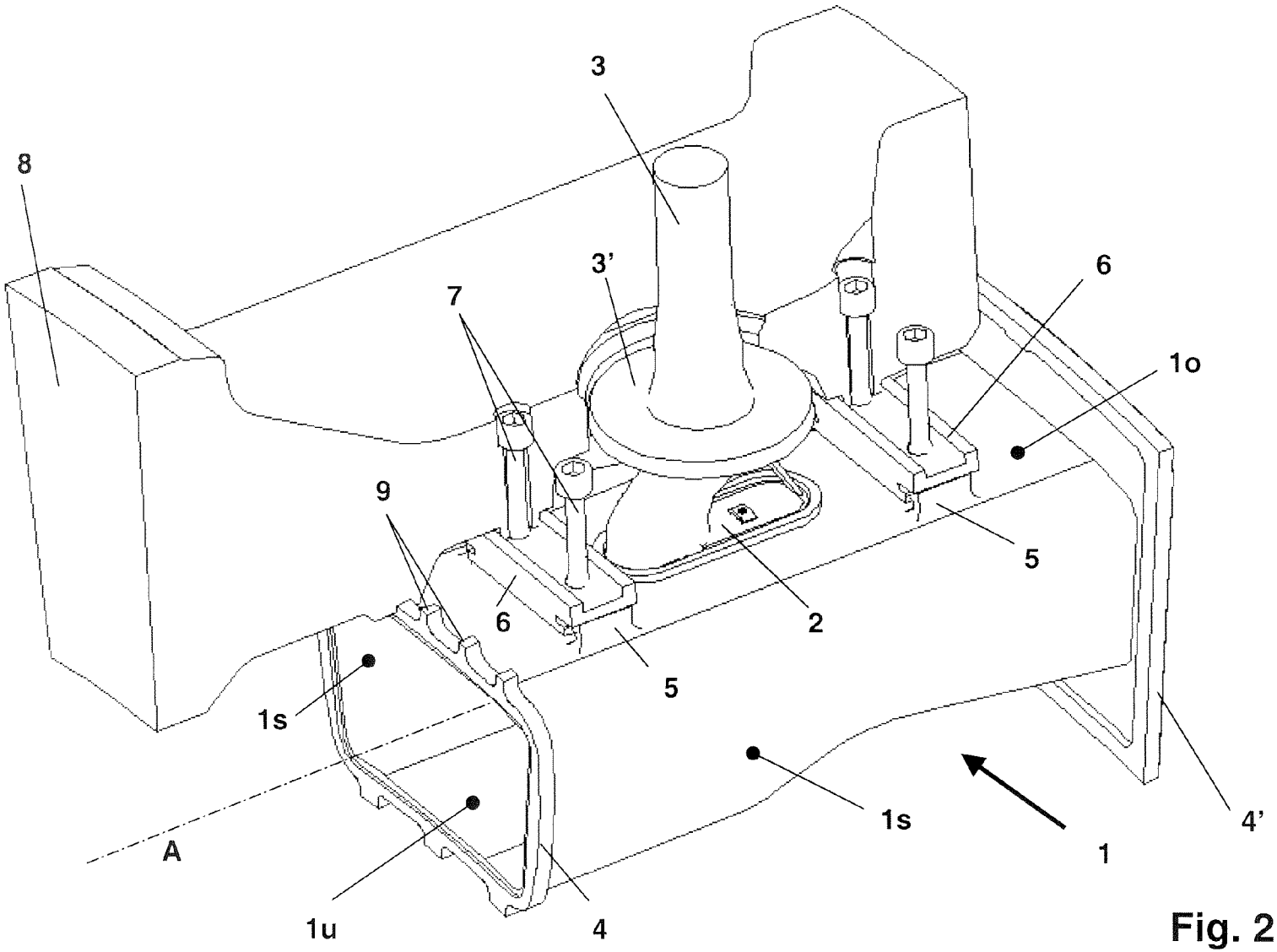
FIG. 2 shows the prior art, a perspective illustration of an SEV burner fastening, FIGS. 3*a, b, c* show perspective illustrations of an alternative possibility for fastening the carrier plate to the SEV burner, FIGS. 4*a, b* show more detailed illustrations regarding the exemplary embodiment according to FIG. 3, FIGS. 5*a, b* show an alternative design of a carrier plate with axial and radial fixing to the fastening flange, FIGS. 6*a, b, c* show diagrammatic illustrations of the mounting of a plate element on the underside of the flow duct of an SEV burner.

From the above statements regarding the description of the SEV burner designed according to the solution, it may be gathered, with reference to all the figures, that the lower flow duct wall 1*u*, in contrast to the upper, is carried solely by the two burner flanges 4 and 4' and the flow duct sidewalls 1*s* (see, for example, the illustration according to FIG. 2). So that thermal expansions can be compensated for, the lower flow duct wall 1*u* is not connected to a carrier part provided for the upper flow duct wall. The rigidity inherent in the lower flow duct wall 1*u* is therefore afforded solely by the flanges 4 and 4' and, if appropriate, by an additional rib. It is clear that deformations along the lower flow duct wall 1*u* may occur as a result of thermal stresses and compressive forces.

Due to the high process temperatures arising inside the SEV burner, it is clear that considerable heat radiation also occurs via the lower flow duct wall 1*u* in the direction of the radially inner plant components which are provided with a corresponding protective coating in order to avoid oxidation caused by heat radiation.

To avoid thermal overloading of inner plant components and to avoid the provision of an additional oxidation protection layer, it was acknowledged, according to the present invention, to connect the lower flow duct wall to an additional plate element which is slidably mounted, spaced apart from the lower flow duct wall via spacer devices, and thereby helps to avoid a direct introduction of heat radiation to inner plant components, such as, in particular, the SEV internal carrier.

Figure 6:
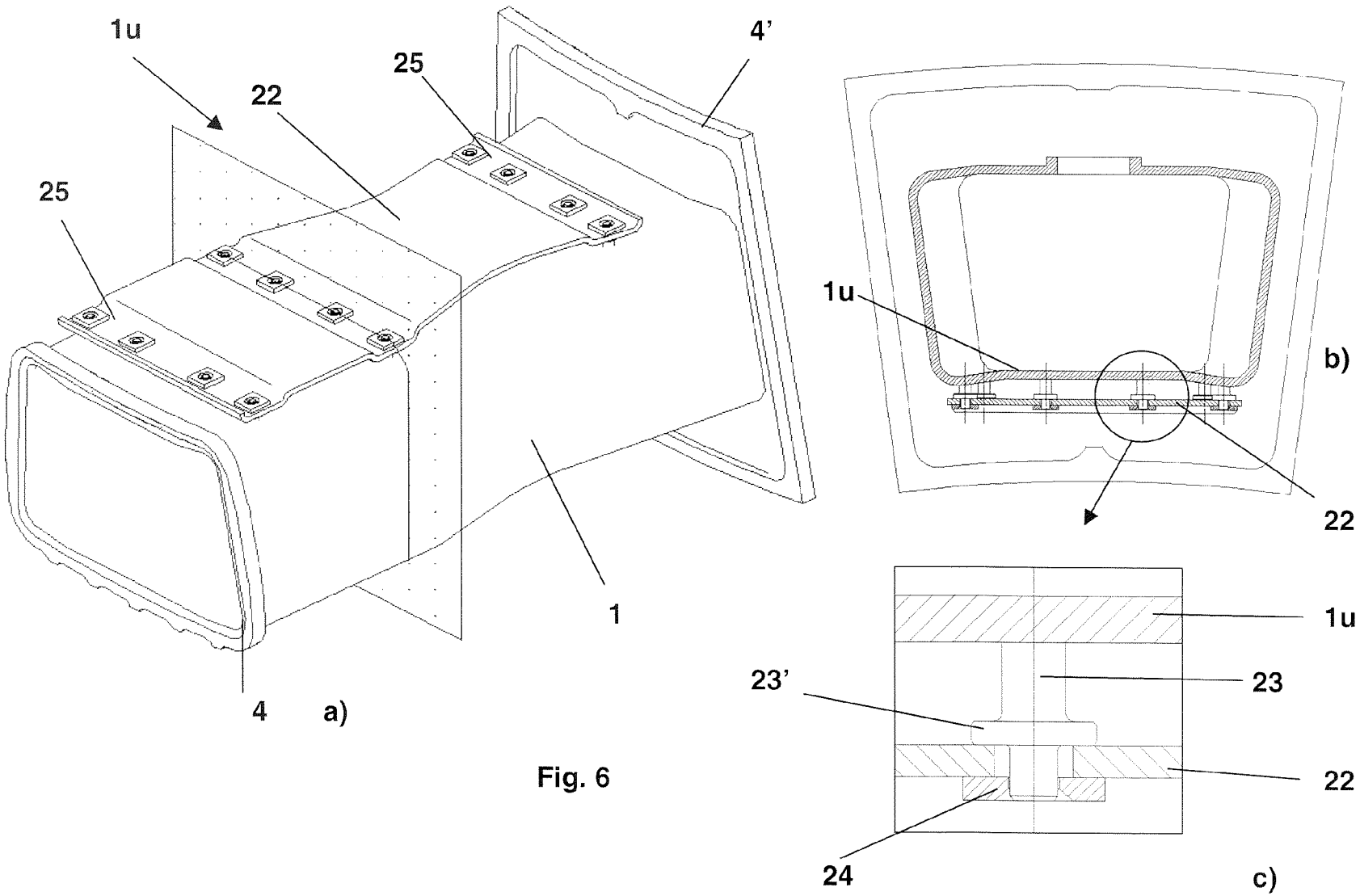

A plate element of this type is illustrated in FIG. 6*a*, which shows an illustration of a top view of the lower flow duct wall 1*u* of the SEV burner 1. It may therefore be assumed that the SEV burner 1 is connected to a first turbine stage, not illustrated any further, by the fastening flange 4. The plate element 22 is connected along its axial surface extent to the lower flow duct wall 1*u* via individual linearly arranged spacer devices, while the exact fastening mechanism may be gathered from the illustration of the detail according to FIG. 6*c*. Thus, directly with the lower flow duct wall 1*u*, in each case at the location of a sliding fastening, a fastening pin 23, as it is known, is provided, which provides a mushroom-shaped portion 23' against which the plate element 22 bears slidably. The plate element 22 is pressed slidably against the mushroom-shaped portion 23' via a type of snap connection 24. This applies to all the fastening points of the plate element 22 with respect to the lower flow duct wall 1*u*, as may be gathered, for example, from a cross-sectional illustration according to FIG. 6*b*. The distance between the plate element 22 and the lower flow duct wall 1*u* is selected such that effusion cooling of the SEV burner is not influenced. Different thermal expansions of the SEV burner and of the plate element 22 can be absorbed or compensated for on account of the sliding suspension, as described above. To increase the surface rigidity of the plate element 22, the surface element 22 provides local profile offsets 25 (FIG. 6*a*), along which the sliding fastening points are mounted. Owing to the surface element 22 which is continuous over a large area, the heat radiated from the SEV burner cannot reach directly the radially inner internal carrier, so that the latter is protected passively against the heat radiation of the SEV burner and ultimately requires no oxidation protection layer which has to be provided in a complicated way.

Figure 7:
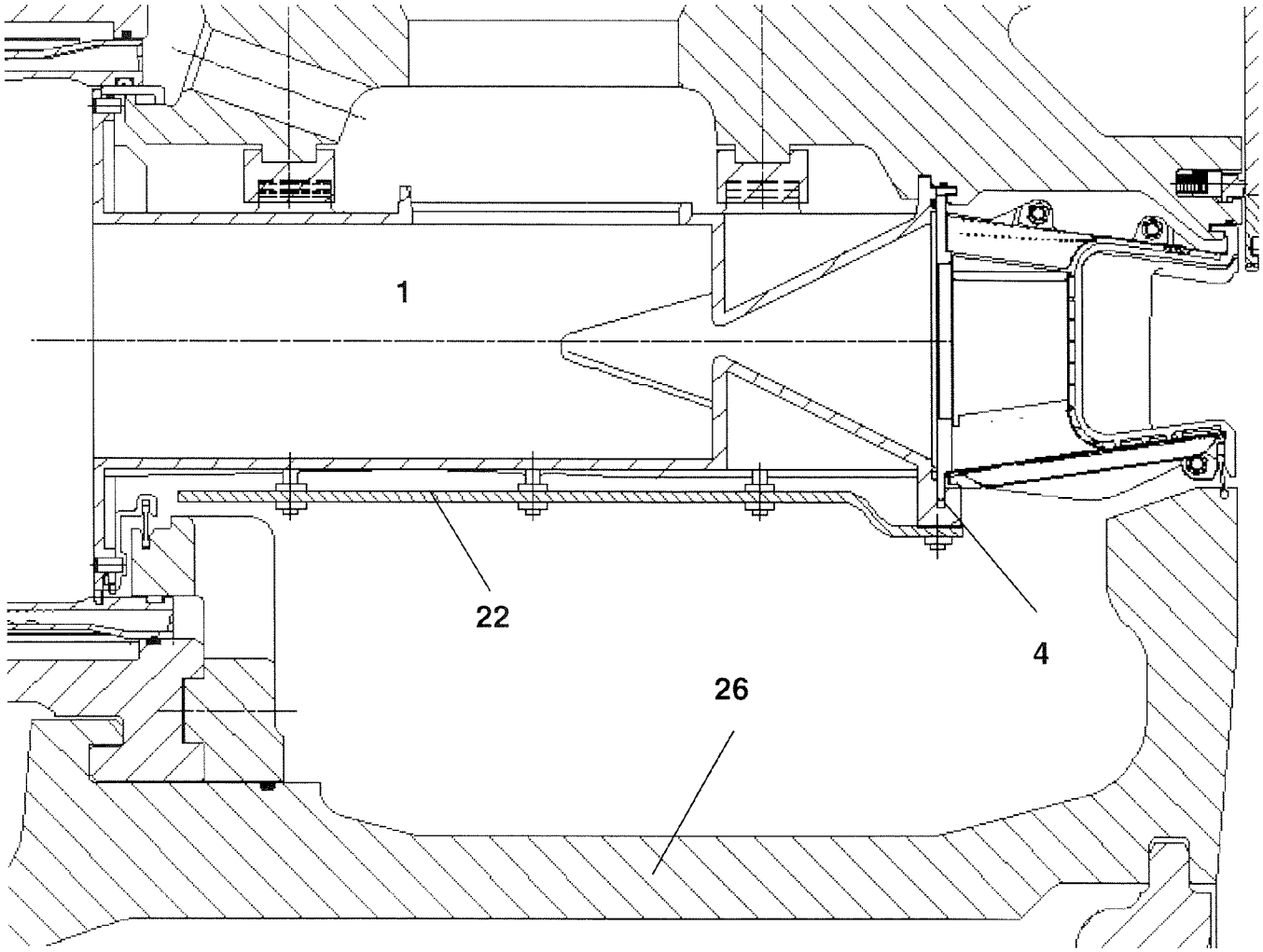
FIG. 7 shows an alternative embodiment of the mounting of a plate element on an SEV burner.

FIG. 7 illustrates a further exemplary embodiment of the design and mounting of a plate element 22 on the lower flow duct wall 1*u*. In this case FIG. 7 shows a longitudinal sectional illustration through an SEV burner 1 and the radially inner internal carrier 26. In this case, the plate element 22 projects, upstream, beyond the region of the SEV burner as far as the burner flange 4, the burner flange or inlet flange 4 being of offset design and via which the plate element 22 is suitably guided and is fixed to the latter via hooks.

Figure 8:
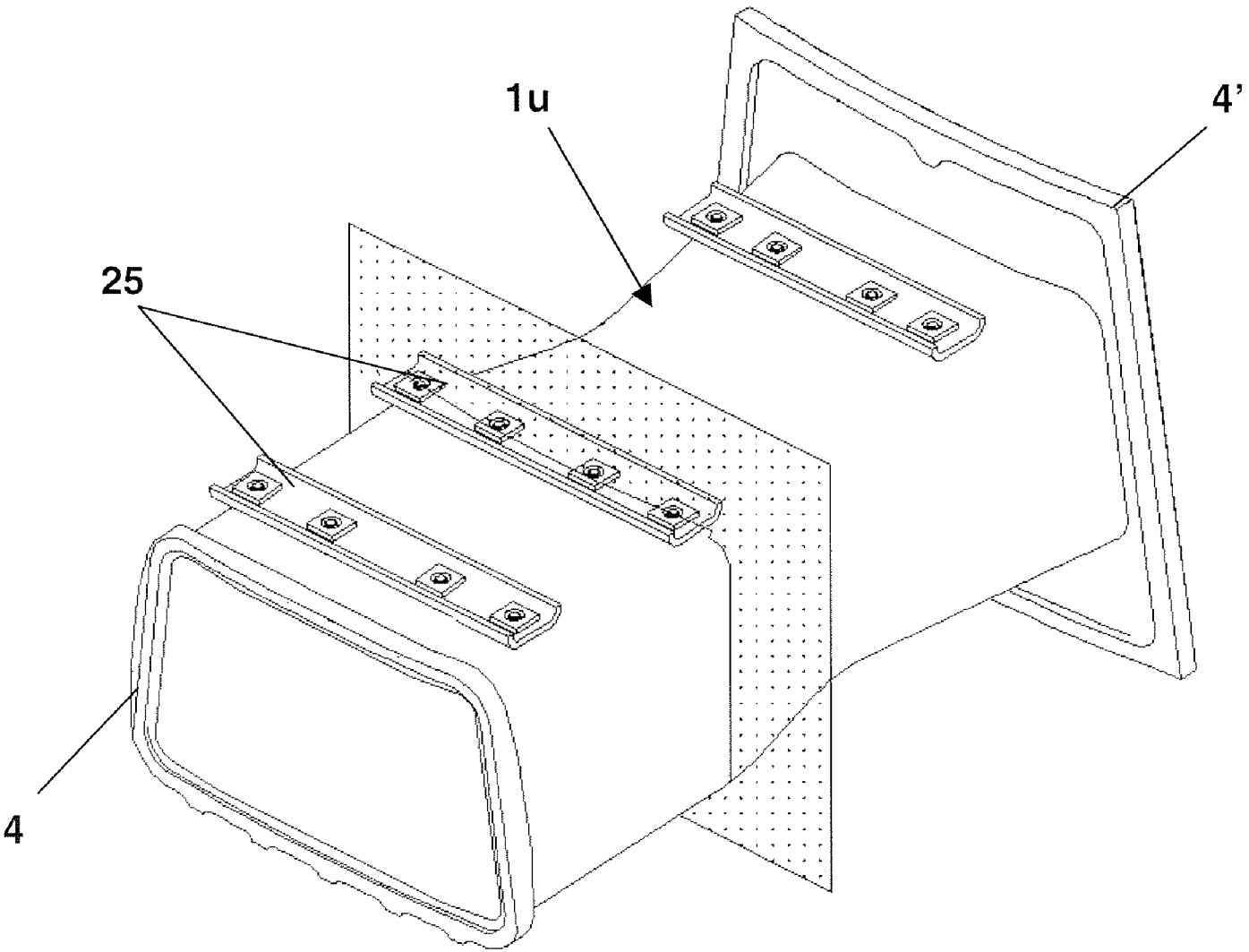
FIG. 8 shows an alternative embodiment of the mounting of plate elements on the underside of an SEV burner.

In the exemplary embodiment according to FIG. 8, the plate element 22 of large-area design is formed in a reduced manner solely to the regions of the profile countersinks 25, with the result that weight can be reduced, but this variant cannot protect the radially inner internal carrier against the direct heat radiation of the SEV burner 1. Instead, due to the U-shape of the profile countersinks 25, the rigidity of the sheets is increased and therefore the rigidity of the lower flow duct wall 1*u* is increased. This embodiment constitutes simply an alternative to the conventional wall stiffening by means of profiles.

LIST OF REFERENCE SYMBOLS

1 flow duct
1*o* upper flow duct wall
1*u* lower flow duct wall
1*s* flow duct sidewalls
2 orifice
3 burner lance
3' support
4 burner flange, burner inlet flange
4' burner outlet flange
5 fastening structure, reception rails
6 carrying structure
7 fastening device
8 external carrier
9 fixing nose
10 carrier plate
11 reception groove
12 collar
13 fastening lip
14 groove-shaped recess
15 insert element
16 supporting web
17 reception contour
18 collar-like portion
19 sealing device
20 effusion cooling hole
21 introduction flank
22 plate element
23 fastening pin
23' mushroom-shaped portion
24 snap connector
25 profile offset
26 internal carrier While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. An SEV burner fastenable in a sequentially operated gas turbine arrangement, in which arrangement a fuel/air mixture can be burned in a first burner to form hot gases which can subsequently be supplied, partly expanded, for a second combustion to the SEV burner, the SEV burner comprising:

a flow duct wall defining a flow duct;

an orifice formed in the flow duct wall through which a fuel supply can be introduced into the flow duct;

two fastening structures protruding from the flow duct wall positioned axially adjacent to the orifice and opposite one another; and a carrying structure configured and arranged to cooperate with the two fastening structures to fasten the burner to an external carrier;

wherein the carrying structure comprises a unitary carrier plate including elements complementary to the two fastening structures arranged to slidingly engage with and fasten to the two fastening structures, and a recess which corresponds at least to the size of the orifice in the flow duct wall, so that, when fastened to the external carrier, the carrier plate does not cover the orifice of the flow duct wall;

wherein the SEV burner is sequentially mounted after a first burner.

2. The SEV burner as claimed in claim 1, further comprising:

a groove-shaped recess on the carrier plate; and at least one collar adjacent to the orifice which projects vertically beyond the flow duct wall and including a fastening lip which is configured and arranged to be introduced into the groove-shaped recess on the carrier plate.

3. The SEV burner as claimed in claim 1, wherein the at least one collar is connected in one piece to the flow duct wall.

4. The SEV burner as claimed in claim 1, further comprising:

an insert element configured and arranged to be inserted into the orifice from the flow duct;

wherein the insert element comprises the at least one collar.

5. The SEV burner as claimed in claim 4, wherein the insert element comprises:

a lower peripheral supporting web configured and arranged to be laid against the inside of the flow duct sidewall in a region directly adjacent to the orifice; and a wear-resistant surface layer at least in surface regions with which the insert element comes into contact with the burner and for the fuel supply.

6. The SEV burner as claimed in claim 4, wherein the insert element comprises cooling orifices open at least to a side facing away from the flow duct.

7. The SEV burner as claimed in claim 1, wherein the flow duct wall includes a portion which lies opposite the orifice, and further comprising:

spacers; and at least one plate element mounted on the flow duct wall portion via the spacers so that the at least one plate element is at least partially spaced from the flow duct wall and slidable with respect to the flow duct wall.

8. The SEV burner as claimed in claim 7, wherein the distance between the at least one plate element and the flow duct sidewall is dimensioned to permit effusion cooling of the burner.

9. The SEV burner as claimed in claim 7, wherein the at least one plate element is mounted and configured to shield against direct heat radiation from the burner.

10. The SEV burner as claimed in claim 7, further comprising:

an inlet flange configured and arranged to fasten the flow duct wall in the gas turbine arrangement;

wherein the at least one plate element axially extends toward the inlet flange and is fixed to the inlet flange.

11. The SEV burner as claimed in claim 2, wherein the least one collar comprises two collars arranged diametrically opposite each other across the orifice.

* * * * *